US010119178B2

(12) United States Patent
Thomas et al.

(10) Patent No.: US 10,119,178 B2
(45) Date of Patent: Nov. 6, 2018

(54) TITANIUM ALLOY WITH IMPROVED PROPERTIES

(75) Inventors: Roger Thomas, Swansea (GB); Paul Garratt, Birmingham (GB); John Fanning, Henderson, NV (US)

(73) Assignee: Titanium Metals Corporation, Dallas, TX (US)

( * ) Notice: Subject to any disclaimer, the term of this patent is extended or adjusted under 35 U.S.C. 154(b) by 216 days.

(21) Appl. No.: 13/349,483

(22) Filed: Jan. 12, 2012

(65) Prior Publication Data

US 2012/0107132 A1 May 3, 2012

(51) Int. Cl.
*C22C 14/00* (2006.01)
*C22F 1/18* (2006.01)

(52) U.S. Cl.
CPC ..... *C22C 14/00* (2013.01); *C22F 1/183* (2013.01)

(58) Field of Classification Search
CPC ..... C22C 14/00; C22F 1/183
USPC ..... 148/421; 420/420
See application file for complete search history.

(56) References Cited

U.S. PATENT DOCUMENTS

| | | | | |
|---|---|---|---|---|
| 2,868,640 | A | 1/1959 | Butler | |
| 2,893,864 | A * | 7/1959 | Harris et al. | 420/419 |
| 4,595,413 | A * | 6/1986 | Hard et al. | 420/417 |
| 5,304,263 | A | 4/1994 | Champin et al. | |
| 5,980,655 | A | 11/1999 | Kosaka | |
| 6,053,993 | A | 4/2000 | Reichman et al. | |
| 6,228,189 | B1 | 5/2001 | Oyama et al. | |
| 6,267,828 | B1 | 7/2001 | Kushida et al. | |
| 2004/0221929 | A1 | 11/2004 | Hebda et al. | |
| 2007/0193018 | A1 | 8/2007 | Davis et al. | |
| 2009/0180918 | A1 | 7/2009 | Tsai et al. | |
| 2009/0255609 | A1 | 10/2009 | Ozbaysal et al. | |
| 2010/0180991 | A1 | 7/2010 | Heritier et al. | |
| 2010/0320317 | A1 | 12/2010 | Fanning | |

(Continued)

FOREIGN PATENT DOCUMENTS

| | | |
|---|---|---|
| EP | 0969109 | 1/2000 |
| GB | 782148 | 9/1957 |
| GB | 785293 A * | 10/1957 |

(Continued)

OTHER PUBLICATIONS

TIMETAL 6-4 Specification Sheet, Titanium Metals Corporation, copyright dated 1998.
Properties and Processing of TIMETAL 6-4, Titanium Metals Corporation, copyright dated 1998.
TIMETAL 550 Specification Sheet, Titanium Metals Corporation, copyright dated 2000.

(Continued)

*Primary Examiner* — Keith Walker
*Assistant Examiner* — John A Hevey
(74) *Attorney, Agent, or Firm* — Burris Law, PLLC

(57) ABSTRACT

A titanium alloy having high strength, fine grain size, and low cost and a method of manufacturing the same is disclosed. In particular, the inventive alloy offers a strength increase of about 100 MPa over Ti 6-4, with a comparable density and near equivalent ductility. The inventive alloy is particularly useful for a multitude of applications including components of aircraft engines. The Ti alloy comprises, in weight percent, about 6.0 to about 6.7% aluminum, about 1.4 to about 2.0% vanadium, about 1.4 to about 2.0% molybdenum, about 0.20 to about 0.42% silicon, about 0.17 to about 0.23% oxygen, maximum about 0.24% iron, maximum about 0.08% carbon and balance titanium with incidental impurities.

20 Claims, 8 Drawing Sheets

(56) References Cited

U.S. PATENT DOCUMENTS

2011/0232349 A1 9/2011 Hebda et al.

FOREIGN PATENT DOCUMENTS

| | | | | |
|---|---|---|---|---|
| JP | 3166350 | | 7/1991 | |
| JP | H05302156 | | 11/1993 | |
| JP | 7054083 | | 2/1995 | |
| JP | 2000273598 | | 10/2000 | |
| JP | 2006283062 | | 10/2006 | |
| JP | 2007084865 | | 4/2007 | |
| RU | 2211874 | | 9/2003 | |
| RU | 2256713 | | 7/2005 | |
| RU | 2008122599 | | 12/2009 | |
| RU | 2393258 | | 6/2010 | |
| WO | WO 0111095 | | 2/2001 | |
| WO | 2003/095690 | | 11/2003 | |
| WO | WO2008003430 | A1 * | 1/2008 | |
| WO | 2010142701 | | 12/2010 | |
| WO | WO2011090402 | A2 * | 7/2011 | ..... C22C 14/00 |

OTHER PUBLICATIONS

PCT Notification of Transmittal of the International Searach Report and the Written Opinion of the International Searching Authority, or the Declaration corresponding International Application No. PCT/US13/21331, filed Jan. 12, 2013.

Sliney, J.L., Status and Potential of Titanium Armor (U), Published in the Proceedings of the Metallurgical Advisory Committee on Rolled Armor, U.S. Army Materials Research Agency, Watertown, MA, Jan. 1964.

Boyer, R. et al., Materials Properties Handbook: Titanium Alloys, ASM International, Jun. 1994, p. 10.

Kolachev B.A. et al., Titanium alloys of other Countries. Spravochnik. M., VILS, 2000, pp. 58-59.

European Search Report for European Application 13735660, dated Jul. 29, 2015.

Lyakishev, N.P., Metallurgy Encyclopedia Dictionary, Moscow, Internet Engineering, 2000, Part 2, p. 83.

Kolachev B.A. et al., Titanium Alloys of Various Countries, Spravochnik. M., VILS, 2000, pp. 58-59.

* cited by examiner

Ti 6Al-4V (Alloy A)

Ti 6Al-2.6V-1Mo (Alloy B)

Ti 6Al-2.6V-1Mo-0.5Si (Alloy C)

Ti 6Al-1.5V-1.5Mo (Alloy E)

TITANIUM ALLOY WITH IMPROVED PROPERTIES

BACKGROUND OF THE INVENTION

I. Field of the Invention

This disclosure relates generally to titanium (Ti) alloys. In particular, alpha-beta Ti alloys having an improved combination of mechanical properties achieved with a relatively low-cost composition are described as well as methods of manufacturing the Ti alloys.

II. Background of the Related Art

Ti alloys have found widespread use in applications requiring high strength-to-weight ratios, good corrosion resistance and retention of these properties at elevated temperatures. Despite these advantages, the higher raw material and processing costs of Ti alloys compared to steel and other alloys have severely limited their use to applications where the need for improved efficiency and performance outweigh their comparatively higher cost. Some typical applications which have benefited from the incorporation of Ti alloys in various capacities include, but are not limited to, aeroengine discs, casings, fan and compressor blades; airframe components; orthopedic components; armor plate and various industrial/engineering applications.

A conventional Ti-base alloy which has been successfully used in a variety of applications is Ti-6Al-4V, which is also known as Ti 6-4. As the name suggests, this Ti alloy generally contains 6 wt. % aluminum (Al) and 4 wt. % vanadium (V). Ti 6-4 also typically includes up to 0.30 wt. % iron (Fe) and up to 0.30 wt. % oxygen (O). Ti 6-4 has become established as the "workhorse" titanium alloy where strength/weight ratio at moderate temperatures is a key parameter for material selection. Ti 6-4 has a balance of properties which is suitable for a wide variety of static and dynamic structural applications, it can be reliably processed to give consistent properties, and it is comparatively economical.

Recently, the design of new aircraft engines has been driven by airline demands for reduced atmospheric emissions and noise, reduced fuel costs, and reduced maintenance and spare part costs. Competition between engine builders has caused them to respond by designing engines with higher bypass ratios, higher pressures in the compressor, and higher temperatures in the turbine. These enhanced mechanical properties require an alloy that has a higher strength than Ti 6-4, but the same density and near equivalent ductility.

Other alloys, such as TIMETAL® 550 (Ti-4.0Al-4.0Mo-2.0Sn-0.5Si) and VT 8 (Ti-6.0Al-3.2Mo-0.4Fe-0.3Si-0.15O), gain approximately 100 MPa of strength compared to Ti 6-4 from the inclusion of silicon in the alloy. However, these alloys have a higher density and a higher production cost, compared to Ti 6-4, because they use molybdenum as the main beta stabilizing element, as opposed to vanadium. The cost premium arises not only from the greater cost of molybdenum relative to vanadium, but also because the use of Ti 6-4 turnings and machining chip as a raw material is precluded in those alloys.

Therefore, there is a need in the industry to provide a cost-effective alloy that has a higher strength, finer grain size, and a particularly improved Low Cycle Fatigue Life with a comparable density when compared to Ti 6-4.

SUMMARY OF THE INVENTION

A titanium alloy having high strength, fine grain size, and low cost and a method of manufacturing the same is disclosed. In particular, the inventive alloy offers a strength increase of about 100 MPa over Ti 6-4, with a comparable density and near equivalent ductility. This improved combination of strength and ductility is maintained at high strain rates. The high strength of the inventive alloy enables it to achieve significantly increased life to failure under Low Cycle Fatigue loading at a given stress, compared to Ti 6-4. The inventive alloy is particularly useful for a multitude of applications including use in components of aircraft engines. The inventive alloy is referred to as the "inventive alloy" or "Ti 639" throughout this disclosure.

The inventive Ti alloy comprises, in weight percent, about 6.0 to about 6.7% aluminum, about 1.4 to about 2.0% vanadium, about 1.4 to about 2.0% molybdenum, about 0.20 to about 0.42% silicon, about 0.17 to about 0.23% oxygen, maximum about 0.24% iron, maximum about 0.08% carbon and balance titanium with incidental impurities. Preferably, the inventive Ti alloy comprises, in weight percent, about 6.0 to about 6.7% aluminum, about 1.4 to about 2.0% vanadium, about 1.4 to about 2.0% molybdenum, about 0.20 to about 0.42% silicon, about 0.17 to about 0.23% oxygen, about 0.1 to about 0.24% iron, maximum about 0.08% carbon and balance titanium with incidental impurities. More preferably, the alloy comprises about 6.3 to about 6.7% aluminum, about 1.5 to about 1.9% vanadium, about 1.5 to about 1.9% molybdenum, about 0.33 to about 0.39% silicon, about 0.18 to about 0.21% oxygen, 0.1 to 0.2% iron, 0.01 to 0.05% carbon, and balance titanium with incidental impurities. Even more preferably, the inventive Ti alloy comprises, in weight percent, about 6.5% aluminum, about 1.7% vanadium, about 1.7% molybdenum, about 0.36% silicon, about 0.2% oxygen, about 0.16% iron, about 0.03% carbon and balance titanium with incidental impurities.

The inventive Ti alloy can also include incidental impurities or other added elements, such as Co, Cr, Cu, Ga, Hf, Mn, N, Nb, Ni, S, Sn, P, Ta, and Zr at concentrations associated with impurity levels for each element. The maximum concentration of any one of the incidental impurity element or other added element is preferably about 0.1 wt. % and the combined concentration of all impurities and/or added elements preferably does not exceed a total of about 0.4 wt. %.

The alloys according to the present disclosure may consist essentially of the recited elements. It will be appreciated that in addition to these elements, which are mandatory, other non-specific elements may be present in the composition provided that the essential characteristics of the composition are not materially affected by their presence.

The inventive alloy having the disclosed composition has a tensile yield strength (TYS) of at least about 145 ksi (1,000 MPa) and an ultimate tensile strength (UTS) of at least about 160 ksi (1,103 MPa) in both longitudinal and transverse directions in combination with a reduction in area (RA) of at least about 25% and an elongation (El) of at least about 10% when evaluated using ASTM E8 standard.

The inventive Ti alloy can be made available in most common product forms including billet, bar, wire, plate and sheet. The Ti alloy can be rolled into a plate having a thickness between about 0.020 inches (0.508 mm) to about 4 inches (101.6 mm). In a particular application, the inventive alloy is made into a plate having a thickness of about 0.8 inches (20.32 mm).

Also described is a method of manufacturing the inventive alloy comprising, in weight percent, about 6.0 to about 6.7% aluminum, about 1.4 to about 2.0% vanadium, about 1.4 to about 2.0% molybdenum, about 0.20 to about 0.42% silicon, about 0.17 to about 0.23% oxygen, about 0.1 to about 0.24% iron, maximum about 0.08% carbon and balance titanium with incidental impurities. Preferably, the Ti alloy is produced by melting a combination of recycled and/or virgin materials comprising the appropriate proportions of aluminum, vanadium, molybdenum, silicon, oxygen, iron, carbon and titanium in a cold hearth furnace to form a molten alloy, and casting said molten alloy into a mold. The recycled materials may comprise, for example, Ti 6-4 turnings and machining chip and commercially pure (CP) titanium scrap. The virgin materials may comprise, for example, titanium sponge, iron powder and aluminum shot. Alternatively, the recycled materials can comprise Ti 6-4 turnings, titanium sponge, and/or a combination of master alloys, iron, and aluminum shot.

The inventive alloy disclosed in this specification provides a comparative alternative to conventional Ti 6-4 alloys while meeting or exceeding mechanical properties established by the aerospace industry for Ti 6-4.

BRIEF DESCRIPTION OF THE DRAWINGS

The accompanying drawings, which are incorporated into and constitute part of this disclosure, illustrate exemplary embodiments of the disclosed invention and serve to explain the principles of the disclosed invention.

Figure 1:
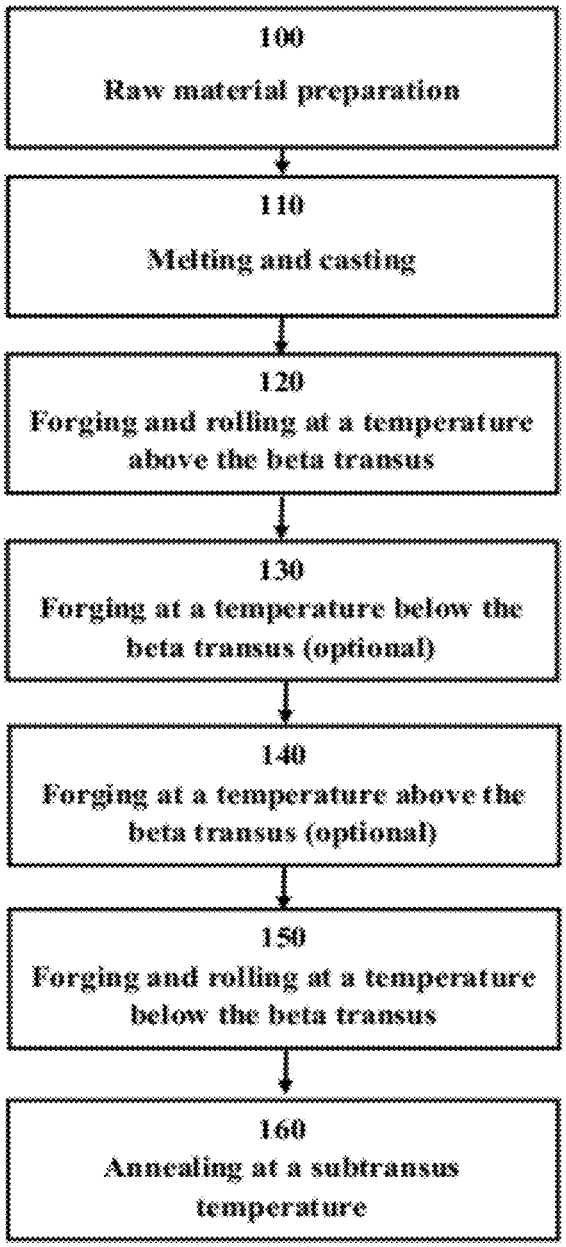
FIG. 1 is a flowchart illustrating a method of producing the inventive alloy in accordance with an embodiment of the present disclosure.

Throughout the drawings, the same reference numerals and characters, unless otherwise stated, are used to denote like features, elements, components or portions of the illustrated embodiments. While the disclosed invention is described in detail with reference to the figures, it is done so in connection with the illustrative embodiments.

DETAILED DESCRIPTION OF THE INVENTION

Exemplary Ti alloys having good mechanical properties which are formed using reasonably low cost materials are described. These Ti alloys are especially suited for use in a multitude of applications including aircraft components requiring higher strength and low cycle fatigue resistance when compared to Ti 6-4, such applications include, but are not limited to, blades, discs, casings, pylon structures or undercarriage. Additionally, the Ti alloys are suited for general engineering components using titanium alloys where higher strength to weight ratio would be advantageous. The inventive alloy is referred to as the "inventive alloy" or "Ti 639" throughout this disclosure.

The inventive Ti alloy comprises, in weight percent, about 6.0 to about 6.7% aluminum, about 1.4 to about 2.0% vanadium, about 1.4 to about 2.0% molybdenum, about 0.20 to about 0.42% silicon, about 0.17 to about 0.23% oxygen, maximum about 0.24% iron, maximum about 0.08% carbon and balance titanium with incidental impurities. Preferably, the inventive Ti alloy comprises, in weight percent, about 6.0 to about 6.7% aluminum, about 1.4 to about 2.0% vanadium, about 1.4 to about 2.0% molybdenum, about 0.20 to about 0.42% silicon, about 0.17 to about 0.23% oxygen, about 0.1 to about 0.24% iron, maximum about 0.08% carbon and balance titanium with incidental impurities. More preferably, the alloy comprises about 6.3 to about 6.7% aluminum, about 1.5 to about 1.9% vanadium, about 1.5 to about 1.9% molybdenum, about 0.33 to about 0.39% silicon, about 0.18 to about 0.21% oxygen, 0.1 to 0.2% iron, 0.01 to 0.05% carbon, and balance titanium with incidental impurities. Even more preferably, the inventive Ti alloy comprises, in weight percent, about 6.5% aluminum, about 1.7% vanadium, about 1.7% molybdenum, about 0.36% silicon, about 0.2% oxygen, about 0.16% iron, about 0.03% carbon and balance titanium with incidental impurities.

Aluminum as an alloying element in titanium is an alpha stabilizer, which increases the temperature at which the alpha phase is stable. Aluminum can be present in the inventive alloy in a weight percentage of about 6.0 to about 6.7%. In particular, the aluminum is present at about 6.0, about 6.1, about 6.2, about 6.3, about 6.4, about 6.5, about 6.6, or about 6.7 wt. %. Preferably, the aluminum is present in a weight percentage of about 6.4 to about 6.7%. Even more preferably, the aluminum is present at about 6.5 wt. %. If the aluminum concentration were to exceed the upper limits disclosed in this specification, the workability of the alloy significantly deteriorates and the ductility and toughness worsen. On the other hand, the inclusion of aluminum levels below the limits disclosed in this specification can produce an alloy in which sufficient strength cannot be obtained.

Vanadium as an alloying element in titanium is an isomorphous beta stabilizer which lowers the beta transformation temperature. Vanadium can be present in the inventive alloy in a weight percentage of about 1.4 to about 2.0%. In particular, the vanadium is present in about 1.4, about 1.5, about 1.6, about 1.7, about 1.8, about 1.9, or 2.0 wt. %. Preferably, the vanadium is present in a weight percentage of about 1.5 to about 1.9%. More preferably, the vanadium is present at about 1.7 wt. %. If the vanadium concentration were to exceed the upper limits disclosed in this specification, the beta-stabilizer content of the alloy will be too high resulting in an increase in density relative to Ti 6-4. Also, if the vanadium concentration were to increase relative to the molybdenum content, the primary alpha grain size of the alloy would tend to increase. On the other hand, the use of vanadium levels that are too low can result in a deterioration in the strength and ductility of the alloy as the alloy tends toward near-alpha, rather than a true alpha-beta alloy. FIG.

3 provides a schematic diagram of the considerations in optimizing the vanadium and molybdenum contents of the inventive alloy.

Molybdenum as an alloying element in titanium is an isomorphous beta stabilizer which lowers the beta transformation temperature. Using the appropriate amount of molybdenum to cause refinement of the primary alpha grain size can provide improved ductility and fatigue life compared to an alloy using only vanadium as the beta stabilizing element. Molybdenum can be present in the inventive alloy in a weight percentage of about 1.4 to about 2.0%. In particular, the molybdenum is present in about 1.4, about 1.5, about 1.6, about 1.7, about 1.8, about 1.9, or about 2.0 wt. %. Preferably, the molybdenum is present in a weight percentage of about 1.5 to about 1.9%. Even more preferably, molybdenum is present at about 1.7 wt. %. If the molybdenum concentration were to exceed the upper limits disclosed in this specification, there is a technical disadvantage of increased density relative to Ti 6-4, and there is an economical and industrial consequence because the preeminence of Ti 6-4 as an industrial titanium alloy results in most of the scrap available for incorporation into ingots having that composition. Since the total beta stabilizer content of the alloy is limited to control the density, the proportion of beta stabilizers added as molybdenum is limited in order to optimize the economics of manufacture. On the other hand, the use of molybdenum levels below the limits disclosed in this specification can result in a deterioration in the strength and ductility of the alloy as the alloy tends toward near-alpha, rather than a true alpha-beta alloy.

Silicon as an alloying element in titanium is a eutectoid beta stabilizer which lowers the beta transformation temperature. Silicon can increase the strength and lower the density of titanium alloys. Additionally, silicon addition provides the required tensile strength without a major loss of the ductility, particularly when the molybdenum and vanadium balance is optimized. Furthermore, the silicon provides elevated temperature tensile properties relative to Ti 6-4 and similar to TIMETAL® 550. Silicon can be present in the inventive alloy in a weight percentage of about 0.2 to 0.42%. In particular, the silicon is present in about 0.20, about 0.22, about 0.24, about 0.26, about 0.28, about 0.30, about 0.32, about 0.34, about 0.36, about 0.38, about 0.40, or about 0.42 wt. %. Preferably, the silicon is present in a weight percent of about 0.34 to 0.38%. More preferably, the silicon is present at about 0.36 wt. %. If the silicon concentration were to exceed the upper limits disclosed in this specification, ductility, and toughness of the alloy will be deteriorated. On the other hand, the use of silicon levels below the limits disclosed in this specification can produce an alloy which has inferior strength.

Iron as an alloying element in titanium is a eutectoid beta stabilizer which lowers the beta transformation temperature, and iron is a strengthening element in titanium at ambient temperatures. Iron can be present in the inventive alloy in a maximum weight percentage of 0.24%. In particular, the iron can be present in about 0.04, about 0.8, about 0.10, about 0.12, about 0.15, about 0.16, about 0.20, or about 0.24 wt. %. Preferably, the iron is present in a weight percentage of about 0.10 to about 0.20%. More preferably, iron is present at about 0.16 wt. %. If the iron concentration were to exceed the upper limits disclosed in this specification, there will potentially be a segregation problem with the alloy and ductility and formability will consequently be reduced. On the other hand, the use of iron levels below the limits disclosed in this specification can produce an alloy that fails to achieve the desired high strength, deep hardenability, and excellent ductility properties.

Oxygen as an alloying element in titanium is an alpha stabilizer, and oxygen is an effective strengthening element in titanium alloys at ambient temperatures. Oxygen can be present in the inventive alloy in a weight percentage of about 0.17 to about 0.23%. In particular, the oxygen is present at about 0.17, about 0.18, about 0.19, about 0.20, about 0.21, about 0.22, or about 0.23 wt. %. Preferably, the oxygen is present in a weight percent of about 0.19 to about 0.21%. More preferably, oxygen is present at about 0.20 wt. %. If the content of oxygen is too low, the strength can be too low and the cost of the Ti alloy can increase because scrap metal will not be suitable for use in the melting of the Ti alloy. On the other hand, if the oxygen content is too great, ductility, toughness and formability will be deteriorated.

Carbon as an alloying element in titanium is an alpha stabilizer, which increases the temperature at which the alpha phase is stable. Carbon can be present in the inventive alloy in a maximum weight percentage of about 0.08%. In particular, the carbon is present in about 0.01, about 0.02, about 0.03, about 0.04, about 0.05, about 0.06, about 0.07, or about 0.08 wt. %. Preferably, the carbon is present in a weight percent of about 0.01 to about 0.05%. More preferably, the carbon is present at about 0.03%. If the content of carbon is too low, the strength of the alloy can be too low and the cost of the Ti alloy can increase because scrap metal will not be suitable for use in the melting of the Ti alloy. On the other hand, if the carbon content is too great, then the ductility of the alloy will be reduced.

The alloys according to the present disclosure may consist essentially of the recited elements. It will be appreciated that in addition to those elements, which are mandatory, other non-specific elements may be present in the composition provided that the essential characteristics of the composition are not materially affected by their presence.

The inventive Ti alloy can also include incidental impurities or other added elements, such as Co, Cr, Cu, Ga, Hf, Mn, N, Nb, Ni, S, Sn, P, Ta, and Zr at concentrations associated with impurity levels for each element. The maximum concentration of any one of the incidental impurity element or other added element is preferably about 0.1 wt. % and the combined concentration of all impurities and/or added elements preferably does not exceed a total of about 0.4 wt. %.

The density of the inventive alloy is calculated to be between about 0.1614 pounds per cubic inch ($lb/in^3$) (4.47 $g/cm^3$) and about 0.1639 $lb/in^3$ (4.54 $g/cm^3$) with a nominal density of about 0.1625 $lb/in^3$ (4.50 $g/cm^3$).

The inventive alloy has a beta transus of about 1850° F. (1010° C.) to about 1904° F. (1040° C.). The microstructure of the inventive alloy is indicative of an alloy processed below the beta transus. Generally, the microstructure of the inventive alloy has a primary alpha grain size at least as fine as, or finer than, Ti 6-4. In particular, the microstructures of the inventive alloy comprise primary alpha phase (white particles) in a background of transformed beta phase (dark background). It is preferable to obtain a microstructure in which the primary alpha grain size is as fine as possible, in order to maintain ductility as the strength of the alloy is increased by varying the composition. In one embodiment the primary alpha grain size may be less than about 15 μm.

The inventive Ti alloy achieves excellent tensile properties. For example, when analyzed according to the ASTM E8 standard, the inventive Ti alloy has a tensile yield strength (TYS) of at least about 145 ksi (1,000 MPa) and an ultimate tensile strength (UTS) of at least about 160 ksi (1,103 MPa) along both transverse and longitudinal directions. Additionally, the Ti alloy has an elongation of at least about 10%, and a reduction of area (RA) of at least about 25%.

The inventive titanium alloy has a molybdenum equivalence ($Mo_{eq}$) of 2.6 to 4.0, wherein the molybdenum equivalence is defined as: $Mo_{eq}$=Mo+0.67V+2.9Fe. In a particular application, the $Mo_{eq}$ is 3.3.

The inventive titanium alloy aluminum equivalence ($Al_{eq}$) of 10.6 to about 12.9 wherein the aluminum equivalence is defined as: $Al_{eq}$=Al+27O. In a particular application, the $Al_{eq}$ is 11.9.

Additionally, the inventive alloy maintains its strength advantage over Ti 6-4 at high strain rates while exhibiting equivalent ductility to Ti 6-4. Furthermore, ballistic testing has shown that the inventive alloy exhibits resistance to fragment simulating projectiles which is equal to or greater than that of Ti 6-4. In particular, the inventive alloy demonstrates a V50 of at least 60 fps in ballistic testing performed using 0.50 Cal. (12.7 mm) Fragment Simulating Projectiles (FSP). In particular applications, the inventive alloy demonstrates a V50 of at least 80 fps. Also the inventive alloy exhibits comparable fracture toughness when compared to Ti 6-4. As is the case for Ti 6-4, the inventive alloy is recognized to be capable of a range of property combinations, dependent on the processing and heat treatment of the material.

The inventive alloy can be manufactured into different products or components having a variety of uses. For example, the inventive alloy can be formed into aircraft components such as discs, casings, pylon structures or undercarriages as well as automotive parts. In a particular application, the inventive alloy is used as a fan blade.

Also disclosed is a method for manufacturing a Ti alloy having good mechanical properties. The method includes melting a combination of source materials in the appropriate proportions to produce the inventive alloy comprising, in weight about 6.0 to about 6.7% aluminum, about 1.4 to about 2.0% vanadium, about 1.4 to about 2.0% molybdenum, about 0.20 to about 0.42% silicon, about 0.17 to about 0.23% oxygen, about 0.1 to about 0.24% iron, maximum about 0.08% carbon and balance titanium with incidental impurities. Melting may be accomplished in, for example, a cold hearth furnace, optionally followed by remelting in a vacuum arc remelting (VAR) furnace. Alternatively, ingot production may be accomplished by multiple melting in VAR furnaces. The source materials may comprise a combination of recycled and virgin materials such as titanium scrap and titanium sponge in combination with small amounts of iron. Under most market conditions, the use of recycled materials offers significant cost savings. The recycled materials used may include, but are not limited to, Ti 6-4, Ti-10V-2Fe-3Al, other Ti—Al—V—Fe alloys, and CP titanium. Recycled materials may be in the form of machining chip (turnings), solid pieces, or remelted electrodes. The virgin materials used may include, but are not limited to, titanium sponge, aluminum-vanadium; aluminum-molybdenum; and titanium-silicon master alloys, iron powder, silicon granules, or aluminum shot. Since the use of Ti—Al—V alloy recycled materials allow reduced or no aluminum-vanadium master alloy to be used, significant cost savings can be attained. This does not, however, preclude the use and addition of virgin raw materials comprising titanium sponge and alloying elements rather than recycled materials if so desired.

The manufacturing method can also include melting ingots of the alloy and forging the inventive alloy in a sequence above and below the beta transformation temperature followed by forging and/or rolling below the beta transformation temperature. In a particular application, the method of manufacturing the Ti alloy is used to produce components for aviation systems, and even more specifically, to produce plates used in the manufacture of fan blades.

A flowchart which shows an exemplary method of manufacturing the Ti alloys is provided in FIG. 1. Initially, the desired quantity of raw materials having the appropriate concentrations and proportions are prepared in step 100. The raw materials can comprise recycled materials although they may be combined with virgin raw materials of the appropriate composition in any combination.

After preparation, the raw materials are melted and cast to produce an ingot in step 110. Melting may be accomplished by, for example, VAR, plasma arc melting, electron beam melting, consumable electrode skull melting or combinations thereof. In a particular application, double melt ingots are prepared by VAR and are cast directly into a crucible having a cylindrical shape.

In step 120, the ingot is subjected to initial forging or rolling. The initial forging or rolling is performed above the beta transformation temperature. If rolling is performed at this step, then the rolling is performed in the longitudinal direction. In a particular application the ingot of the titanium alloy is heated to a temperature between about 40 and about 200 degrees Centigrade above the beta transus temperature and forged to break down the cast structure of the ingot and then cooled. Preferably, the ingot of the titanium alloy is heated to a temperature between about 90 to about 115 degrees Centigrade above the beta transus. Even more preferably, the ingot is heated to about 90 degrees above the beta transus.

In step 130, which is optional, the ingot is reheated below the beta transformation temperature and forged to deform the transformed structure. In a particular application, the ingot is reheated to a temperature between about 30 and about 100 degrees Centigrade below the beta transus. Preferably, the ingot is reheated to a temperature between about 40 to about 60 degrees Centigrade below the beta transus. More preferably, the ingot is reheated to a temperature about 50 degrees Centigrade below the beta transus.

Next, in step 140, which is optional, the ingot is reheated to a temperature above the beta transus temperature to allow recrystallization of the beta phase, then forged to a strain of at least 10 percent and water quenched. In a particular application, the ingot is reheated to a temperature between about 30 and about 150 degrees Centigrade above the beta transus temperature. Preferably, the ingot is reheated to a temperature between about 40 and about 60 degrees Centigrade above the beta transus temperature. Even more preferably, the ingot is reheated to a temperature about 45 degrees Centigrade above the beta transus temperature.

In step 150 the ingot is subject to further forging and/or rolling to produce a plate, bar, or billet. The wrought ingot produced by step 120, or by optional steps 130 or 140, if performed, is reheated to a temperature between about 30 and about 100 degrees Centigrade below the beta transus and rolled to plate, bar, or billet of the desired dimensions, with the metal being reheated as necessary to allow the desired dimensions and microstructure to be achieved. In a particular application, the ingot is reheated to a temperature between about 30 and about 100 degrees Centigrade below the beta transus temperature. Preferably, the ingot is reheated to a temperature between about 40 and about 60 degrees Centigrade below the beta transus temperature.

More preferably, the ingot is reheated to a temperature about 50 degrees Centigrade below the beta transus temperature.

Rolling of plate is typically (but optionally) accomplished in at least two stages, so that the material can be rotated through 90 degrees between stages, in order to promote the development of the microstructure of the plate. The final forging and rolling is performed below the beta transformation temperature with rolling being performed in the longitudinal and transverse directions, relative to the ingot axis.

The ingot is then annealed in step 160 which is preferably performed below the beta transformation temperature. The final rolled product may have a thickness which ranges from, but is not limited to, about 0.020 inches (0.508 mm) to about 4.0 inches (101.6 mm). In some variations, the annealing of plates may be accomplished with the plate constrained to ensure that the plate complies to a required geometry after cooling, In another application, plates may be heated to the annealing temperature and then leveled before annealing.

In some applications, rolling to gages below about 0.4 inches (10.16 mm) may be accomplished by hot rolling to produce a coil or strip product. In yet another application, rolling to thin gage sheet products may be accomplished by hot rolling of sheets as single sheets or as multiple sheets encased in steel packs.

Additional details on the exemplary titanium alloys and methods for their manufacture are described in the Examples which follow.

EXEMPLARY EMBODIMENTS

The examples provided in this section serve to illustrate the processing steps used, resulting composition and subsequent properties of Ti alloys prepared according to embodiments of the present invention. The Ti alloys and their associated methods of manufacture which are described below are provided as examples and are not intended to be limiting.

Example 1

Elemental Effects on a Ti 6-4 Base

Several Ti alloys having compositions outside the elemental ranges disclosed in this specification were initially prepared to serve as comparative examples. In evaluating the effectiveness of the elements contained in the proposed alloy, two series of 200 g buttons were melted and then (β then α/β) rolled to 13 mm square bars. The results are summarized in Table 1 below.

Table 1 provides the tensile test results from five alloys including Ti 6-4. Table 1 demonstrates that comparable tensile test results were obtained when vanadium was substituted with molybdenum. Specifically, when the proportions of molybdenum and vanadium were varied between 1% to 2.6%, only minor changes in tensile strength compared to Ti 6-4 were observed (compare Alloys A, B, D, and E).

Table 1 also shows that the inclusion of 0.5% silicon resulted in a significant strength increase compared to an alloy without this element (compare Alloy C with Alloy B). Alloys A, B, D, and E were given a 2 stage heat treatment typically applied to Ti 6-4. Alloy C was heat treated under different conditions compared to the other alloys because of the inclusion of silicon. This heat treatment was selected because the prior art alloys that contain Si, such as TIMETAL® 550, suggested that the optimum properties of such alloys is typically attained when the final step of heat treatment is an aging process in the temperature range 400 to 500° C.

Figure 2A:
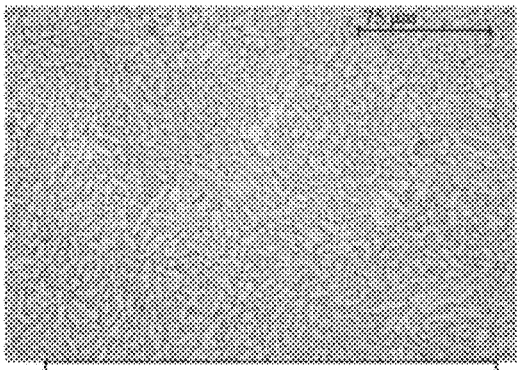
FIG. 2A is a microphotograph of a Ti 6-4 alloy.
Figure 2B:
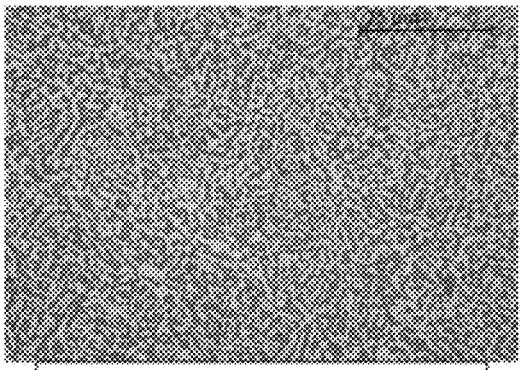
FIG. 2B is a microphotograph of a comparative alloy containing Ti-6Al-2.6V-1Mo.
Figure 2C:
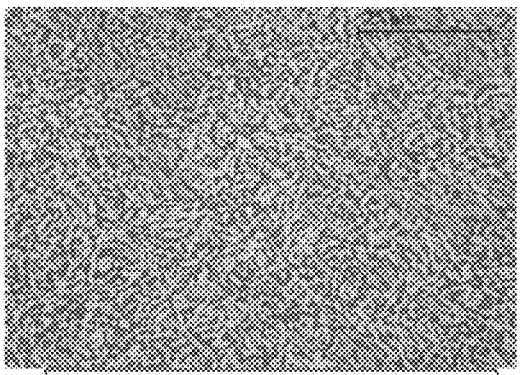
FIG. 2C is a microphotograph of a comparative alloy containing Ti-6Al-2.6V-1Mo-0.5Si.
Figure 2D:
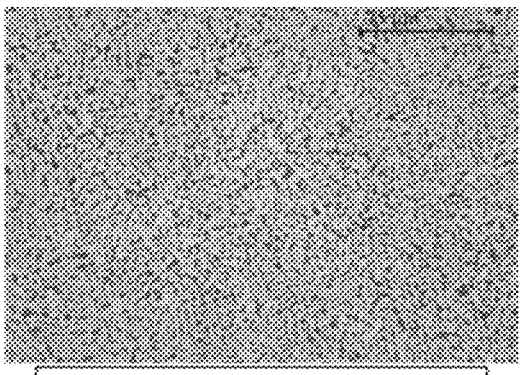
FIG. 2D is a microphotograph of a Ti alloy in accordance with an exemplary embodiment of the present disclosure.

In titanium alloys, as for other metallic materials, the grain size has an influence on the mechanical properties of the material. Finer grain size is typically associated with higher strength, or with higher ductility at a given strength level. FIG. 2 shows the microstructure of experimental titanium alloys (see Table 1 for compositions) cast as 250 g ingots and converted by forging and rolling to 12 mm square bars. These microstructures comprise of primary alpha phase (white particles) in a background of transformed beta phase (dark background). FIG. 2A shows the microstructure of Alloy A (Ti 6-4) produced by this method, as a benchmark. It is desirable to obtain a microstructure in which the primary alpha grain size is as fine as possible, in order to maintain ductility as the strength of the alloy is increased by varying the composition. FIGS. 2B to 2D show the microstructures of experimental alloys (Alloys B, C, and E) containing molybdenum, which caused the transformed beta phase to appear darker. It had been empirically observed that titanium alloys in which molybdenum is the main beta stabilizing element tend to have a finer beta grain size than those in which vanadium is the main beta stabilizer. FIG. 2 shows that Alloy E (FIG. 2D) exhibited a finer primary alpha phase than Alloy A (Ti 6-4) (FIG. 2A), while Alloys B and C (FIGS. 2B and 2C) had grain sizes similar to that of Ti 6-4 (FIG. 2A). FIG. 2 demonstrates that in alloys containing both vanadium and molybdenum, the proportion of molybdenum present must be equal to or greater than the proportion of vanadium in order to obtain the desirable finer grain size.

Table 2 provides an additional set of eight buttons (nominal compositions) along with their tensile test results.

TABLE 1

| | Composition of Ti alloy (wt %) | | | | | | Second Heat | 0.2% PS | UTS | % El | % |
|---|---|---|---|---|---|---|---|---|---|---|---|
| Alloy | Al | V | Mo | Si | O | Fe | Treatment Step | (MPa) | (MPa) | (5.65√So) | RA |
| A (Ti64) | 6.5 | 4.2 | — | — | 0.185 | 0.17 | 700 C./2 hr AC | 890 | 989 | 17.5 | 42 |
| B | 6.5 | 2.6 | 1 | — | 0.195 | 0.17 | 700 C./2 hr AC | 904 | 1002 | 17 | 42 |
| C | 6.5 | 2.6 | 1 | 0.5 | 0.21 | 0.17 | 400 C./24 hr AC | 1028 | 1172 | 16.5 | 37 |
| D | 6.5 | 1.5 | 1 | — | 0.2 | 0.17 | 700 C./2 hr AC | 877 | 994 | 18 | 38 |
| E | 6.5 | 1.5 | 1.5 | — | 0.2 | 0.17 | 700 C./2 hr AC | 899 | 1009 | 19 | 44 |

Note:

Tensile properties were evaluated using ASTM E8 standard. AC = Air Cooled; PS = Proof Stress; Initial Heat Treatment Step = 960° C./30 mins/AC.

TABLE 2

Button Compositions and Tensile Test Results

| Alloy | Composition of Ti alloy (wt %) Al | V | Mo | Si | O | Fe | β Transus (° C.) | E (GPa) | 0.2% PS (MPa) | UTS (MPa) | % El (5.65√So) | % RA |
|---|---|---|---|---|---|---|---|---|---|---|---|---|
| F (Ti64) | 6.5 | 4.2 | — | — | 0.2 | 0.17 | 995/1000 | 112 | 898 | 1048 | 16.5 | 37 |
| G | 6.5 | 4.2 | — | 0.5 | 0.2 | 0.17 | 1000/1005 | 112 | 1024 | 1165 | 14.5 | 35 |
| H | 6.5 | — | 3.2 | 0.35 | 0.2 | 0.17 | 1025/1030 | 114 | 1014 | 1188 | 14.5 | 38 |
| I | 6.5 | 2 | 2 | 0.5 | 0.2 | 0.17 | 1005/1010 | 112 | 1049 | 1218 | 13.5 | 40 |
| J | 6.5 | 2 | 2 | 0.35 | 0.2 | 0.17 | 1005/1010 | 113 | 1012 | 1187 | 15 | 40 |
| K | 6.5 | 1.5 | 1.5 | 0.5 | 0.2 | 0.17 | 1020/1025 | 114 | 996 | 1159 | 14.5 | 31 |
| L | 6.5 | 1.5 | 1.5 | 0.35 | 0.2 | 0.17 | 1020/1025 | 115 | 951 | 1125 | 15 | 37 |
| M | 6.5 | 2 | 2 | 0.5 | 0.15 | 0.17 | 995/1000 | 115 | 1016 | 1187 | 13.5 | 42 |

Note:

All samples were solution heat treated at beta transformation temperature minus 40° C. for 1 hr and air cooled, then aged at 400° C. for 24 hrs and air cooled.

The results reported in Table 2 demonstrate the strengthening effect of including silicon in alloy compositions. For example, adding silicon to a Ti 6-4 base resulted in a substantial increase in tensile strength (compare Alloy F with Alloy G). Table 2 also shows that for any given base composition, the inclusion of 0.5% Si compared to 0.35% Si resulted in a higher strength (compare H, J, and L with I, K, and M, respectively).

Table 2 also shows the effects of varying the amount of molybdenum and vanadium in the alloys. Alloys that contained 2% Mo and 2% V had a higher strength and ductility compared to alloys that contained 1.5% Mo and 1.5% V (compare I and J with L and M, respectively).

Additionally, decreasing the oxygen content resulted in a lower strength for a given base composition (compare M with I). Furthermore, Table 2 shows that the elastic modulus varies little over the range of compositions analyzed.

Figure 3:
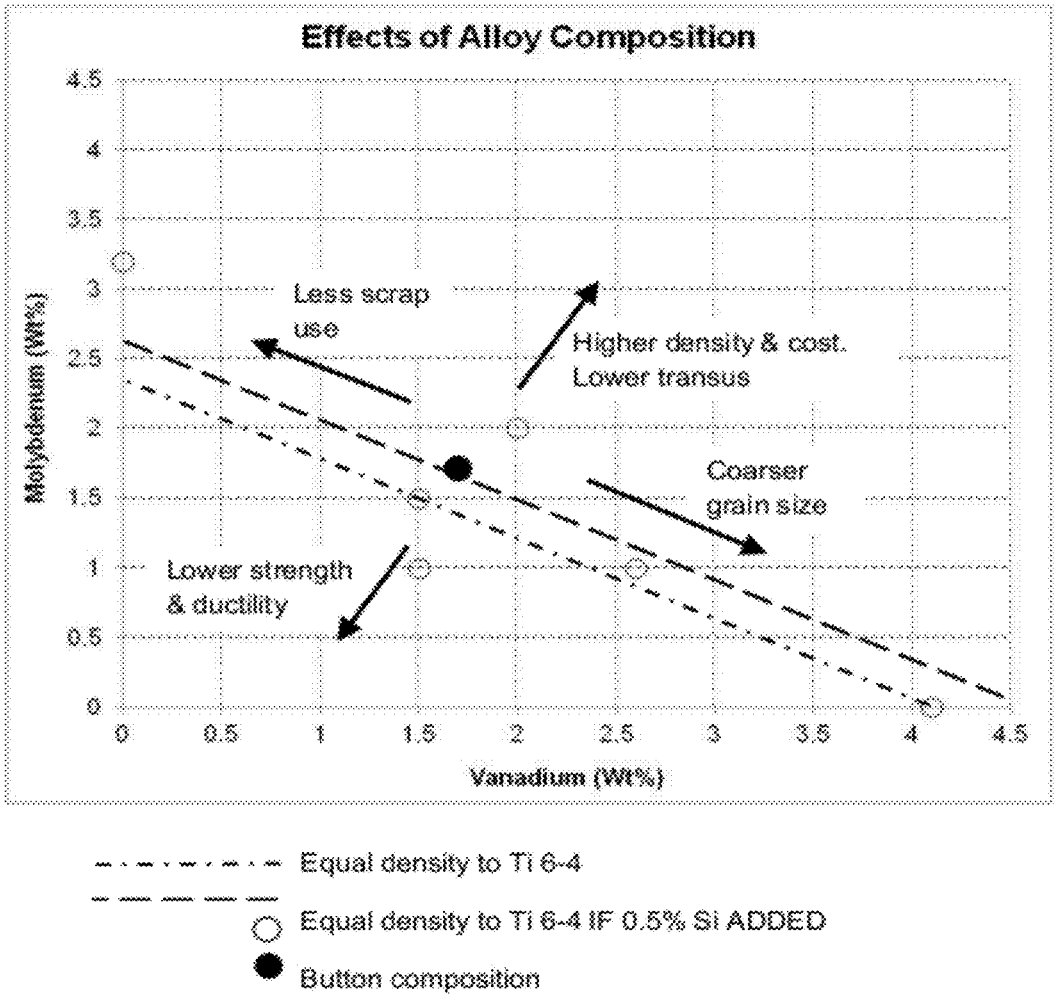
FIG. 3 is schematic illustrating the considerations affecting various properties of the alloy based on the alloy's composition.

FIG. 3 shows schematically the considerations affecting the molybdenum and vanadium balance selection. Using sufficient molybdenum to cause refinement of the primary alpha grain size is important in that it promotes superior fatigue performance relative to Ti 6-4 (similar to TIMETAL® 550). However, using an increased proportion of molybdenum has an economic/industrial consequence, in that the pre-eminence of Ti 6-4 as an industrial titanium alloy results in most of the scrap available for incorporation into ingots having that composition. Availability of scrap for incorporation has a major effect on the economics of introducing a novel alloy to industrial production.

The experimental work provided evidence that the principles of alloy design in FIG. 3 are effective in practice. The silicon addition provided an increase in tensile strength without a major loss of ductility, particularly when the molybdenum/vanadium balance was optimized. The inclusion of silicon also provided significant elevated temperature tensile properties relative to Ti 6-4 (similar to TIMETAL® 550).

Example 2

Additional experiments were performed to evaluate the chemical composition, calculated parameters, tensile properties, and ballistic properties of the inventive alloy. In particular, six ingots were melted as 8 inch (203 mm) diameter double VAR containing the compositions shown in Table 3 below. The material was converted to 0.62 inch (15.7 mm) plate with final subtransus rolling of 40% reduction in thickness in each direction.

Using the average chemical analysis results for the inventive alloy (Ti 639; Heat V8116), the beta transus was calculated to be 1884° F. (1029° C.). This value was confirmed using metallographic observation after quenching from successively higher annealing temperatures.

Density

The density of an alloy is an important consideration where the alloy selection criterion is (strength/weight) or (strength/weight squared). For an alloy which is proposed to be a substitute for Ti 6-4, it is particularly useful for the density to be equal to that of Ti 6-4 since this would allow substitution without design change where higher material performance is required.

Density calculations for each of the tested alloys is reported in Table 3. Using the rule of mixtures, the density for V8116 (Ti-6.5Al-1.8V-1.7Mo-0.16Fe-0.3Si-0.2O-0.03C) was calculated as 0.1626 lbs $in^{-3}$ (4.50 g $cm^{-3}$). When calculated on the same basis, the density of Ti 6-4 was 0.1609 lbs $in^{-3}$ (4.46 g $cm^{-3}$). Therefore, the density of V8116 is greater than that of Ti 6-4 by a factor of only about 1.011.

Solution Treated Plus Overaged (STOA) Condition

Prior to determining the tensile properties of each alloy, the plates were heat treated to the solution treated plus overaged (STOA) condition as follows: Anneal 1760° F. (960° C.), 20 minutes, air cool (AC) to room temperature, then age 1292° F. (700° C.) for 2 h, AC.

Tensile property results are provided in Table 4. The Ti 6-4 baseline (V8111) exhibited typical properties for this formulation and heat treatment condition. The specific UTS and specific TYS of the inventive alloy (V8116) were approximately 9% and 12% higher, respectively, than that of the similarly processed Ti 6-4.

Ballistic Properties

Lab-scale ingots of the comparative compositions identified in Table 3 were melted and converted to 0.62 in (15.7 mm) cross-rolled plate. Tensile and ballistic evaluations were performed in the solution treated plus overaged condition as follows: Anneal 1760° F. (960° C.), 20 minutes, air cool (AC) to room temperature, then age 1292° F. (700° C.) for 2 h, AC.

Ballistic property results are provided in Table 3. Ballistic testing was performed using 0.50 Cal. (12.7 mm) Fragment Simulating Projectiles (FSP). Three plates were tested: V8111 (Ti 6-4), V8113 (Ti-6.5Al-1.8V-1.4Mo0.16Fe-0.5Si-0.2O-0.06C), and V8116 (Ti-6.5Al-1.8V-1.7Mo-0.16Fe-0.3Si-0.2O-0.03C).

The ballistic results for V8116 were favorable demonstrating a V50 at 81 feet per second (fps) above the base requirement; localized adiabatic shear was not a dominant failure mechanism; and no secondary cracking occurred. The last observation is especially important because it indicates that the 0.03 wt % C and 0.3 Si wt % did not have a deleterious effect on the impact resistance. The overall ballistic performance for V8116 for these particular test conditions was found to be similar to that of Ti 6-4 (V8111). Therefore, the benefit of the higher strength of the V8116 composition can be realized without suffering a decrease in impact resistance.

In contrast, heat V8113, which had tensile properties similar to V8116 but had higher Si (0.5 vs. 0.3 wt %) and higher C (0.06 vs. 0.03 wt %), had a low V50 value (92 fps below the base requirement) and exhibited severe cracking that resulted in the plate breaking in half during the testing. The cracking of V8113 occurred even with shots of relatively low sectional impact energies. Additionally, V8113 exhibited cracking both between shots and to the corner of the plate; this behavior was not observed for Ti 6-4 (V8111) or V8116.

The combination of high strength (167 ksi UTS and 157 ksi), high elongation (11%), and good ballistic and impact properties observed for V8116 (Ti-6.5Al-1.8V-1.7Mo-0.16Fe-0.3Si-0.2O-0.03C) was very favorable considering that it avoids large alloy additions which would tend to increase density and cost that are normally associated with this strength level in Ti alloy plate.

TABLE 3

| Material | | Product Composition, wt % | | | | | | | | | | | | | |
|---|---|---|---|---|---|---|---|---|---|---|---|---|---|---|---|
| Base | Heat | Al | C | Cr | Fe | Mo | N | Ni | O | Si | Sn | V | Zr | Nb | Ti |
| Ti 639 | V8112 | 6.4 | 0.014 | 0.001 | 0.16 | 1.7 | 0.004 | | 0.221 | 0.448 | | 1.8 | | | 89.2 |
| Ti 639 | V8113 | 6.4 | 0.057 | 0.001 | 0.16 | 1.4 | 0.004 | | 0.209 | 0.467 | | 1.8 | | | 89.5 |
| Ti 639 | V8116 | 6.5 | 0.034 | 0.001 | 0.16 | 1.7 | 0.004 | | 0.213 | 0.292 | | 1.8 | | | 89.3 |
| Ti 639 | FU83099 | 6.6 | 0.030 | | 0.16 | 1.8 | 0.003 | | 0.213 | 0.292 | | 1.7 | | | 89.3 |
| Ti64 | V8111 | 6.3 | 0.026 | 0.001 | 0.16 | 0.0 | 0.005 | | 0.200 | 0.023 | | 4.1 | | | 89.2 |
| Ti64 + C | V8117 | 6.4 | 0.051 | 0.001 | 0.16 | 0.0 | 0.005 | | 0.213 | 0.038 | | 4.1 | | | 89.1 |
| Ti64 + C | V8118 | 6.4 | 0.053 | 0.001 | 0.16 | 0.0 | 0.005 | | 0.212 | 0.067 | | 4.1 | | | 89.0 |
| Ti 639 | spec min | 6.0 | 0.010 | 0.001 | 0.10 | 1.4 | 0.005 | | 0.170 | 0.200 | | 1.4 | | | 90.7 |
| Ti 639 | spec max | 6.7 | 0.080 | 0.001 | 0.24 | 2.0 | 0.005 | | 0.230 | 0.420 | | 2.0 | | | 88.3 |
| Ti 639 | lowest density | 6.7 | 0.080 | 0.001 | 0.10 | 1.4 | 0.005 | | 0.230 | 0.420 | | 1.4 | | | 89.7 |
| Ti 639 | highest density | 6.0 | 0.010 | 0.001 | 0.24 | 2.0 | 0.005 | | 0.170 | 0.200 | | 2.0 | | | 89.4 |
| Ti 639 | typical | 6.5 | 0.030 | 0.001 | 0.17 | 1.7 | 0.005 | | 0.200 | 0.360 | | 1.7 | | | 89.3 |
| Ti 64 | UK blend | 6.5 | 0.010 | 0.001 | 0.17 | 0.0 | 0.005 | | 0.210 | 0.010 | | 4.2 | | | 88.9 |

| Material | | Calculated Parameters [1] | | | | | | | |
|---|---|---|---|---|---|---|---|---|---|
| | | Density | | $T_\beta$ | | | | | $\beta_{ISO}$ |
| Base | Heat | g/cc | lb/in$^3$ | ° F. | $Al_{eq}$ | $Mo_{eq}$ | $\beta_{ISO}$ | $\beta_{EUT}$ | $\beta_{EUT}$ |
| Ti 639 | V8112 | 4.50 | 0.1626 | 1855 | 12.4 | 3.4 | 2.9 | 0.4 | 6.5 |
| Ti 639 | V8113 | 4.48 | 0.1619 | 1905 | 12.1 | 3.1 | 2.6 | 0.5 | 5.7 |
| Ti 639 | V8116 | 4.51 | 0.1627 | 1888 | 12.2 | 3.4 | 2.9 | 0.4 | 6.5 |
| Ti 639 | FU83099 | 4.50 | 0.1626 | 1888 | 12.3 | 3.3 | 2.9 | 0.5 | 6.1 |
| Ti64 | V8111 | 4.45 | 0.1606 | 1861 | 11.7 | 3.2 | 2.7 | 0.5 | 6.0 |
| Ti64 + C | V8117 | 4.45 | 0.1606 | 1894 | 12.1 | 3.2 | 2.7 | 0.5 | 5.9 |
| Ti64 + C | V8118 | 4.45 | 0.1605 | 1896 | 12.1 | 3.2 | 2.7 | 0.5 | 6.0 |
| Ti 639 | spec min | 4.49 | 0.1622 | 1843 | 10.6 | 2.6 | 2.3 | 0.3 | 8.1 |
| Ti 639 | spec max | 4.52 | 0.1631 | 1927 | 12.9 | 4.0 | 3.3 | 0.7 | 4.8 |
| Ti 639 | lowest density | 4.47 | 0.1614 | 1955 | 12.9 | 2.6 | 2.3 | 0.3 | 8.1 |
| Ti 639 | highest density | 4.54 | 0.1639 | 1815 | 10.6 | 4.0 | 3.3 | 0.7 | 4.8 |
| Ti 639 | typical | 4.50 | 0.1625 | 1871 | 11.9 | 3.3 | 2.8 | 0.5 | 5.8 |
| Ti 64 | UK blend | 4.45 | 0.1606 | 1852 | 12.2 | 3.3 | 2.8 | 0.5 | 5.7 |

| Material | | Tensile Properties, Plate [2] | | | | | | | | | | Ballistic Properties | | | | |
|---|---|---|---|---|---|---|---|---|---|---|---|---|---|---|---|---|
| | | Mill Annealed | | | | | STA (Air Cool) | | | | | V50 Test vs. 12.7 mm FSP | | | | |
| Base | Heat | UTS ksi | TYS ksi | RA % | El % | E Msi | UTS ksi | TYS ksi | RA % | El % | E Msi | t (in) | Base (fps) | Tested (fps) | Δ (fps) | Comment |
| Ti 639 | V8112 | 161 | 154 | 19 | 11 | 17.3 | 170 | 163 | 23 | 8 | 17.9 | — | — | — | — | Good Strength, marginal ductility |
| Ti 639 | V8113 | 161 | 153 | 20 | 12 | 17.5 | 169 | 158 | 21 | 11 | 18.3 | 0.605 | 3064 | 2972 | −92 | Good strength, good ductility, |

TABLE 3-continued

| | | | | | | | | | | | | | | | | |
|---|---|---|---|---|---|---|---|---|---|---|---|---|---|---|---|---|
| | | | | | | | | | | | | | | | | low V50 and severe cracking |
| Ti 639 | V8116 | 161 | 154 | 25 | 14 | 17.5 | 167 | 157 | 27 | 11 | 18.0 | 0.616 | 3137 | 3218 | +81 | Good combination of strength, ductility, V50, and cracking resistance |
| Ti 639 | FU83099 | 162 | 151 | 29 | 15 | | | | | | | — | — | — | — | |
| Ti64 | V8111 | 151 | 139 | 29 | 13 | 16.4 | 155 | 141 | 30 | 12 | 17.8 | 0.585 | 2935 | 2993 | +58 | Typical strength, elongation and V50 for Ti 6-4 |
| Ti64 + C | V8117 | 156 | 143 | 26 | 14 | 16.7 | 159 | 147 | 26 | 11 | 17.9 | — | — | — | — | Insufficient increase in strength |
| Ti64 + C | V8118 | 156 | 144 | 31 | 15 | 16.6 | 159 | 148 | 27 | 11 | 17.9 | — | — | — | — | Insufficient increase in strength |

[1] Density estimated using rule of mixtures.
$T_\beta$ (beta transus) calculations based on binary equilibrium phase diagrams.
$Al_{eq}$ = Al + 27O
$Mo_{eq}$ = Mo + 0.67V + 2.9Fe
[2] Average of 2 L and 2 T specimens for 0.6 in Plate
El = using (5.65√So)

Example 3

Characteristics of an Intermediate Product Used in the Production of Hollow Titanium Alloy Fan Blades In order to verify the properties of the inventive alloy (designated Ti 639) on an industrial scale, a 30 inch (760 mm) diameter ingot, nominal weight 3.4 MT, designated FU83099, was manufactured by double VAR melting. This ingot was then converted to plate in accordance with the processing principles laid out in FIG. 1, applying industrial practices used for commercial production of Ti 6-4 Fan Blade Plate. Part of the heat (FU83099B) was processed using the cross-rolling process, while another section of the heat (FU83099) was rolled along a single axis.

Room temperature tensile tests were also performed in order to further evaluate the characteristics of Ti 6-4 fan blade plate compared to the inventive alloy plate according to ASTM E8. Chemical compositions of the plates are shown in Table 4 along with the RT tensile test results.

The results from Table 4 further demonstrate that the inventive alloy is stronger than Ti 6-4. Comparison of the results from FU83099A and B demonstrates the greater anisotropy of properties in the material when the rolling is executed along a single axis, compared to cross rolling.

Figure 4:
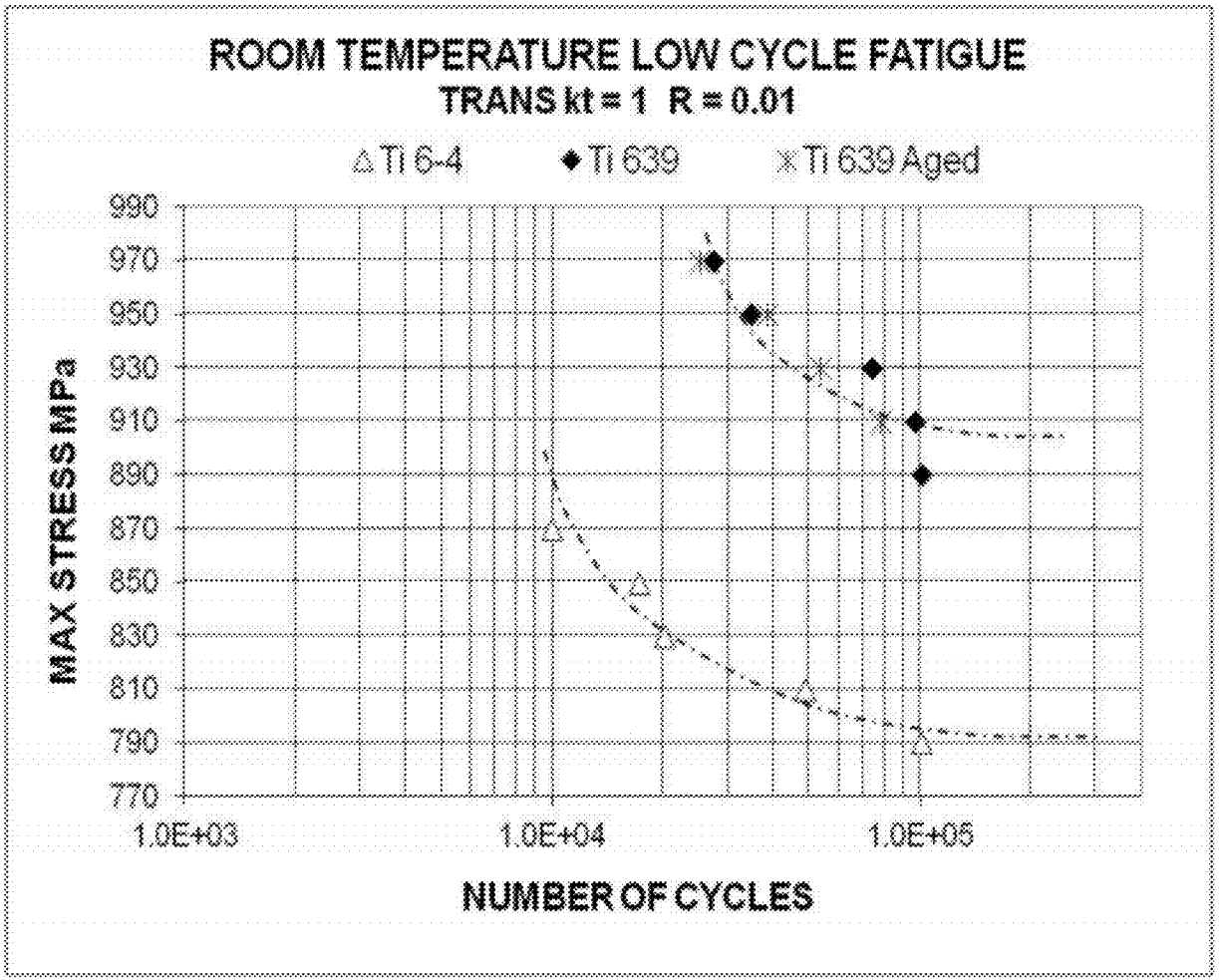
FIG. 4 is a graph providing room temperature low cycle fatigue results using smooth test pieces of the inventive alloy taken traverse to the final rolling direction of the plate compared to Ti 6-4.

Samples taken from FU83099B were heat treated according to a schedule designed to simulate the manufacture of hollow titanium fan blades, and then subjected to a range of mechanical tests. FIGS. 4 to 8 show comparisons between Ti 6-4 and the inventive alloy (FU83099B), shown as Ti 639, in Low Cycle Fatigue testing, which infers the durability of the alloy in component service. FIGS. 4 and 6 show results from test pieces taken transverse and longitudinal respectively to the final rolling direction of the plate. FIGS. 4 and 6 provide the results from testing of 'smooth' test pieces, and clearly show the superiority of the inventive alloy compared to Ti 6-4. FIG. 4 shows results for "Ti 639" and "Ti 639 aged". The "Ti 639 aged" samples received a heat treatment sequence in which the last step was in the aging range, at 500° C., but the "Ti 639" samples received a heat treatment sequence in which the last step was at 700° C., typical of annealing conditions. The results show that the good performance of the inventive alloy is achieved in both cases. The results show significant improvements in smooth low cycle fatigue performance of Ti 639 compared to Ti 6-4. In the transverse direction (FIG. 4) the fatigue life is increased from approximately $1\times10^4$ cycles for Ti 6-4 to about $1\times10^5$ cycles for Ti 639 at a maximum stress of about 890 MPa and the maximum stress for a life of about $1\times10^5$ cycles is increased by approximately 100 MPa from 790 MPa for Ti 6-4 to approximately 890 MPa for Ti 639. In the longitudinal direction, the fatigue life is increased from less than $3\times10^4$ cycles for Ti 6-4 to approximately $1\times10^5$ cycles for Ti 639 at a maximum stress of 830 MPa and the maximum stress for a life of approximately $1\times10^5$ cycles is increased from approximately 790 MPa for Ti 6-4 to about 830 MPa for Ti 639.

Figure 5:
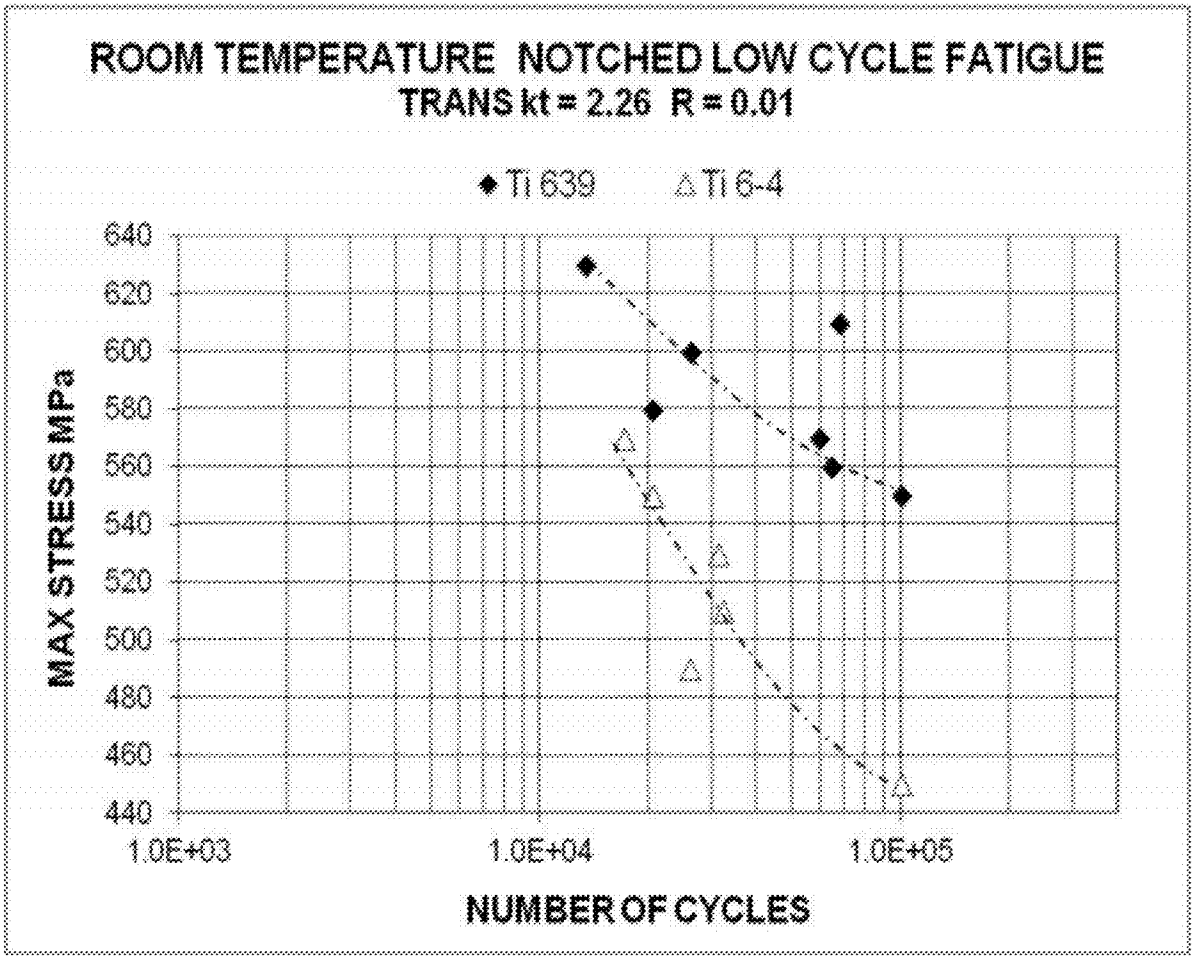
FIG. 5 is a graph providing room temperature low cycle fatigue results using notched test pieces of the inventive alloy taken traverse to the final rolling direction of the plate compared to Ti 6-4.
Figure 6:
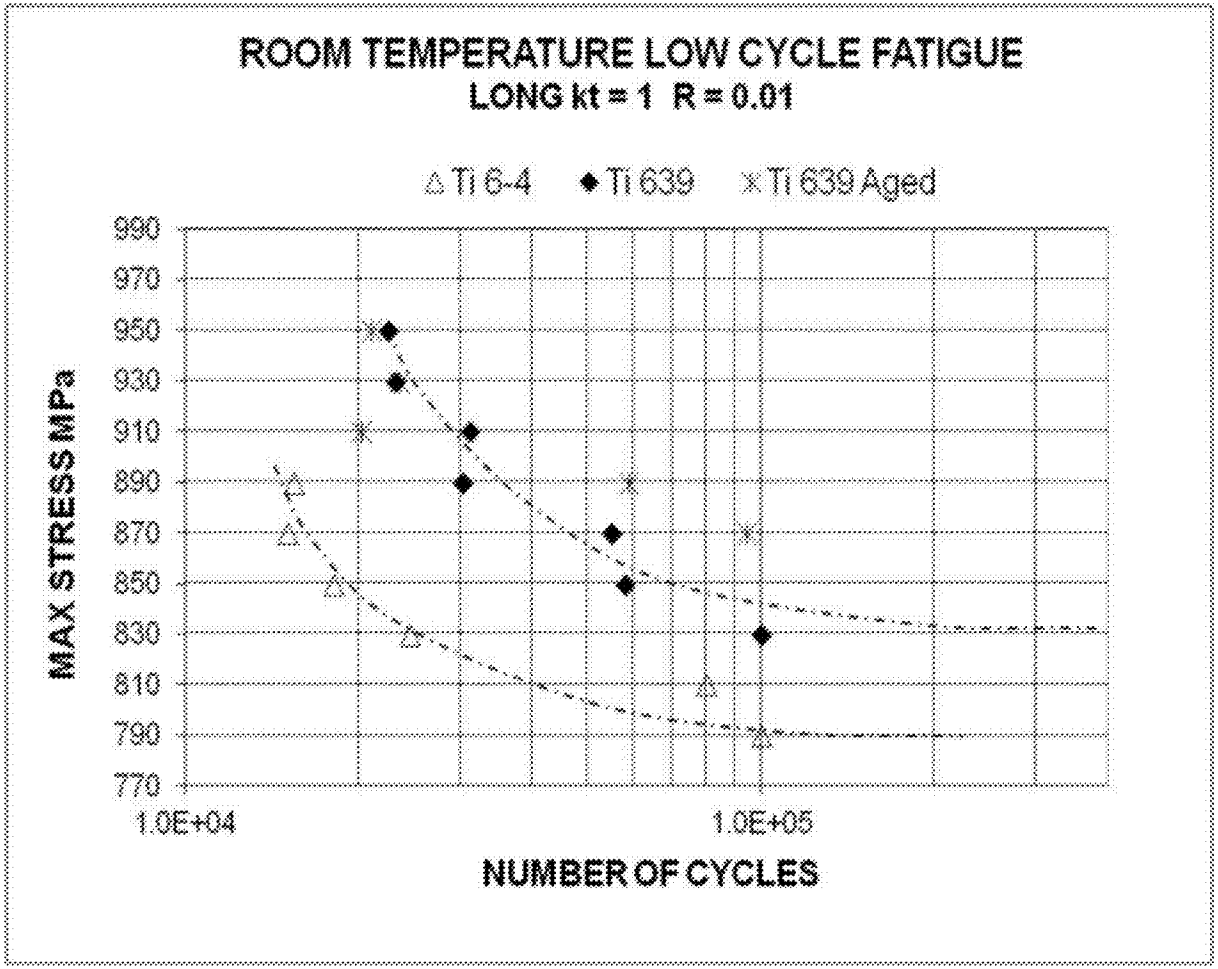
FIG. 6 is a graph providing room temperature low cycle fatigue results using smooth test pieces of the inventive alloy taken longitudinal to the final rolling direction of the plate compared to Ti 6-4.
Figure 7:
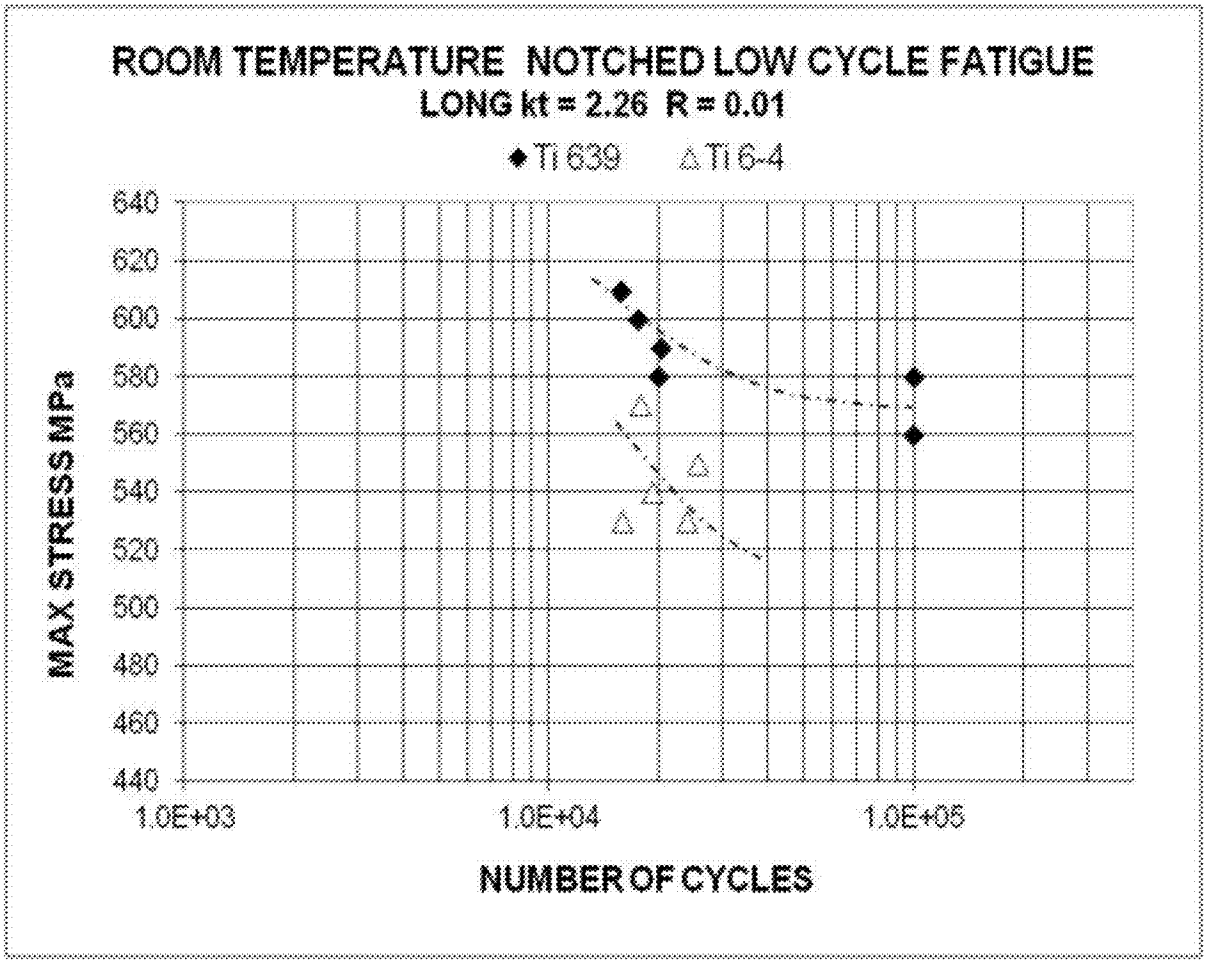
FIG. 7 is a graph providing room temperature low cycle fatigue results using notched test pieces of the inventive alloy taken longitudinal to the final rolling direction of the plate compared to Ti 6-4.

FIGS. 5 and 7 show the results of further Low Cycle Fatigue testing, from a more arduous test which uses a notched test piece. These results further confirm the superiority of the inventive alloy.

Figure 8:
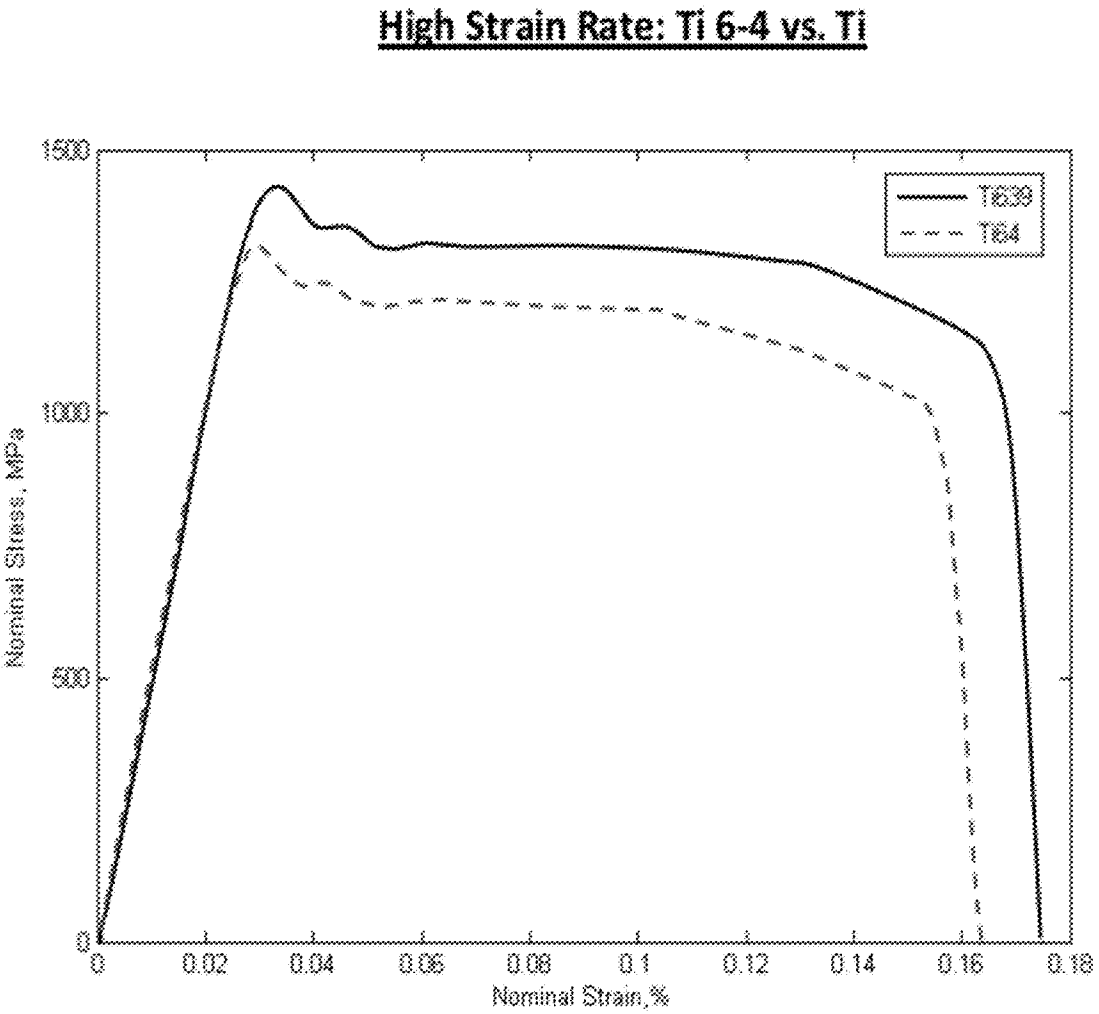
FIG. 8 is a graph providing high strain rate results of the inventive alloy compared to Ti 6-4.

FIG. 8 provides a comparison between Ti 6-4 and the inventive alloy (FU83099B), shown as Ti 639, in high strain rate tensile testing. This data confirmed that the good combination of strength and ductility in the inventive alloy is superior to Ti 6-4 in the service condition relevant to hollow fan blades. This is relevant since such blades must be designed to withstand bird impacts in service, and the ability of the material to withstand such impacts influences the design, mass and efficiency of the component.

TABLE 4

| | Composition of Ti alloy (wt %) | | | | | | | Second Heat | | 0.2% PS | UTS | % El | |
|---|---|---|---|---|---|---|---|---|---|---|---|---|---|
| Alloy | Al | V | Mo | Si | O | Fe | C | Treatment Step | Dir. | (MPa) | (MPa) | (4D) | % RA |
| R (FU83099A2) | 6.33 | 1.63 | 1.66 | 0.31 | 0.207 | 0.17 | 0.026 | 700 C./2 hr AC | L | 1010.8 | 1080.4 | 15.6 | 34.5 |
| | | | | | | | | | L | 1012.8 | 1083.2 | 15.2 | 35.5 |
| | | | | | | | | | T | 1071.5 | 1154.2 | 15.2 | 23.3 |
| | | | | | | | | | T | 1070.8 | 1152.1 | 14.5 | 23.4 |

TABLE 4-continued

| Alloy | Composition of Ti alloy (wt %) Al | V | Mo | Si | O | Fe | C | Second Heat Treatment Step | Dir. | 0.2% PS (MPa) | UTS (MPa) | % El (4D) | % RA |
|---|---|---|---|---|---|---|---|---|---|---|---|---|---|
| S (FU83099B) | 6.34 | 1.63 | 1.7 | 0.31 | 0.203 | 0.17 | 0.024 | 700 C./2 hr AC | L | 1025.9 | 1110.1 | 15.9 | 31.5 |
| | | | | | | | | | L | 1025.9 | 1110.1 | 15.3 | 30.8 |
| | | | | | | | | | T | 1034.9 | 1110.1 | 14.7 | 31 |
| | | | | | | | | | T | 1033.5 | 1111.4 | 17.2 | 27 |
| T (Ti 6-4) | 6.47 | 4.15 | — | 0.02 | 0.219 | 0.13 | 0.015 | 700 C./2 hr AC | L | 960.2 | 1048.6 | 16 | 29.8 |
| | | | | | | | | | L | 954 | 1047.5 | 16 | 33.7 |
| | | | | | | | | | T | 952.4 | 1028.2 | 15.3 | 35.8 |
| | | | | | | | | | T | 948.7 | 1027.6 | 14.3 | 33.6 |

Note:
Initial heat treatment step = 960° C./30 mins/AC

In the interest of clarity, in describing the present invention, the following terms and acronyms are defined as provided below.

Tensile Yield Strength (TYS): Engineering tensile stress at which the material exhibits a specified limiting deviation (0.2%) from the proportionality of stress and strain.

Ultimate Tensile Strength (UTS): The maximum engineering tensile stress which a material is capable of sustaining, calculated from the maximum load during a tension test carried out to rupture and the original cross-sectional area of the specimen.

Modulus of Elasticity (E): Description of tensile elasticity, or the tendency of an object to deform along an axis when opposing forces are applied along that axis. Modulus of elasticity is defined as the ratio of tensile stress to tensile strain.

Elongation (El): During a tension test, the increase in gage length (expressed as a percentage of the original gage length) after fracture. In this work, percentage of elongation was determined using two standard gage lengths. In the first method the gage length was determined according to the formula $5.65\sqrt{So}$ where So is the cross sectional area of the test piece. In the second method, the gage length was 4D where D is the diameter of the test piece. These differences, do not have a material effect on the determination of the percentage of elongation.

Reduction in Area (RA): During a tension test, the decrease in cross-sectional area of a tensile specimen (expressed as a percentage of the original cross-sectional area) after fracture.

Alpha ($\alpha$) stabilizer: An element which, when dissolved in titanium, causes the beta transformation temperature to increase.

Beta ($\beta$) stabilizer: An element which, when dissolved in titanium, causes the beta transformation temperature to decrease.

Beta ($\beta$) transus: The lowest temperature at which a titanium alloy completes the allotropic transformation from an $\alpha+\beta$ to a $\beta$ crystal structure. This is also known as the beta transformation temperature.

Eutectoid compound: An intermetallic compound of titanium and a transition metal that forms by decomposition of a titanium-rich $\beta$ phase.

Isomorphous beta ($\beta_{ISO}$) stabilizer: A $\beta$ stabilizing element that has similar phase relations to $\beta$ titanium and does not form intermetallic compounds with titanium.

Eutectoid beta ($\beta_{EUT}$) stabilizer: A $\beta$ stabilizing element capable of forming intermetallic compounds with titanium.

Proof Stress (PS) The stress that will cause a specified small, permanent extension of a tensile test piece. This value approximates to the yield stress in materials not exhibiting a definite yield point. The value for this set at 0.2% of the strain.

Ingot The product of melting and casting and any intermediate product derived therefrom.

It will be appreciated by persons skilled in the art that the present invention is not limited to what has been particularly shown and described herein. Rather, the scope of the present invention is defined by the claims which follow. It should further be understood that the above description is only representative of illustrative examples of embodiments. For the reader's convenience, the above description has focused on a representative sample of possible embodiments, a sample that teaches the principles of the present invention. Other embodiments may result from a different combination of portions of different embodiments.

The description has not attempted to exhaustively enumerate all possible variations. The alternate embodiments may not have been presented for a specific portion of the invention, and may result from a different combination of described portions, or that other undescribed alternate embodiments may be available for a portion, is not to be considered a disclaimer of those alternate embodiments. It will be appreciated that many of those undescribed embodiments are within the literal scope of the following claims, and others are equivalent. Furthermore, all references, publications, U.S. Patents and U.S. Patent Application Publications cited throughout this specification are hereby incorporated by reference in their entirety as if fully set forth in this specification.

All percentages provided are in percent by weight (wt. %) in both the specification and claims.

What is claimed is:

1. A ballistic titanium alloy consisting of, in weight %, 6.0 to 6.7 aluminum, 1.4 to 2.0 vanadium, 1.4 to 2.0 molybdenum, 0.20 to 0.35 silicon, 0.18 to 0.23 oxygen, 0.16 to 0.24 iron, 0.02 to 0.06 carbon, and balance titanium with incidental impurities;

wherein the maximum concentration of any one impurity element present in the titanium alloy is 0.1 wt. % and the combined concentration of all impurities is less than or equal to 0.4 wt. %, the ballistic titanium alloy having a UTS greater than 950 MPa, a tensile yield strength of at least 1,000 MPa, an elongation of at least 10%, a V50 ballistic limit that is at least 80 feet per second greater than a base V50 ballistic limit measured for a T-64 alloy when a 0.616 inch thick plate is tested against a 12.7 mm diameter steel fragment simulating projectile, and wherein a tensile specimen of the ballistic titanium alloy has a reduction of area (RA) of at least 25% of an original cross-sectional area of the tensile specimen after fracture when evaluated using an ASTM E8 standard.

2. The titanium alloy of claim 1 consisting of, in weight %, about 6.3 to about 6.7 aluminum, about 1.5 to about 1.9 vanadium, about 1.5 to about 1.9 molybdenum, about 0.34 to about 0.35 silicon, about 0.18 to about 0.21 oxygen, 0.16 to 0.2 iron, 0.02 to 0.05 carbon, and balance titanium with incidental impurities.

3. The titanium alloy of claim 1, wherein the weight % of the aluminum is about 6.5.

4. The titanium alloy of claim 1, wherein the weight % of the vanadium is about 1.7.

5. The titanium alloy of claim 1, wherein the weight % of the molybdenum is about 1.7.

6. The titanium alloy of claim 1, wherein the weight % of the silicon is about 0.30.

7. The titanium alloy of claim 1, wherein the weight % of the oxygen is about 0.20.

8. The titanium alloy of claim 1, wherein the weight % of the iron is 0.16.

9. The titanium alloy of claim 1, wherein the weight % of the carbon is about 0.03.

10. The alloy of claim 1 having a molybdenum equivalence ($M_{Oeq}$) of 2.6 to 4.0, wherein the molybdenum equivalence is defined as: $M_{Oeq}=M_O+0.67V+2.9Fe$.

11. The alloy of claim 1 having an aluminum equivalence ($Al_{eq}$) of 10.6 to about 12.9, wherein the aluminum equivalence is defined as: $Al_{eq}=Al+27O$.

12. An aviation component comprising the titanium alloy of claim 1.

13. A fan blade comprising the titanium alloy of claim 1.

14. The titanium alloy of claim 1 consisting of, in weight %, about 6.5 aluminum, 1.7 vanadium, 1.7 molybdenum, about 0.35 silicon, 0.20 oxygen, 0.16 iron, 0.03 carbon, and balance titanium with incidental impurities.

15. A method of manufacturing a titanium alloy, comprising:

a. providing a the titanium alloy of claim 1;

b. performing a first heat treatment of the alloy in (a) to a temperature between 40 and 200 degrees Centigrade above the beta transus temperature and forging to break down the cast structure of the ingot and then cooling the alloy;

c. performing a second heat treatment of the alloy in (b) to a temperature between 30 and 100 degrees Centigrade below the beta transus and rolling the alloy to a plate, bar, or billet; and d. annealing the alloy in (c) at a temperature below the beta transus.

16. The method of claim 15, further comprising the step of: reheating the alloy in step (b) to a temperature between 50 and 150 degrees Centigrade above the beta transus temperature to allow recrystallization of the beta phase.

17. The method of claim 15, further comprising the step of: reheating the alloy to a temperature between 30 to 150 degrees Centigrade above the beta transus temperature to allow recrystallization of the beta phase, then forging to a strain of at least 10 percent and water quenched.

18. A ballistic titanium alloy consisting of, in weight %, 6.0 to 6.7 aluminum, 1.4 to 2.0 vanadium, 1.4 to 2.0 molybdenum, 0.20 to 0.35 silicon, 0.18 to 0.23 oxygen, 0.16 to 0.24 iron, 0.02 to 0.06 carbon and the balance titanium together with any incidental impurities having UTS of at least 160 ksi, a tensile yield strength of at least 145 ksi, an elongation of at least 10%, a V50 ballistic limit that is at least 60 feet per second greater than a base V50 ballistic limit measured for a T-64 alloy when a 0.616 inch thick plate is tested against a 12.7 mm diameter steel fragment simulating projectile, wherein a tensile specimen of the ballistic titanium alloy has a reduction of area (RA) of at least about 25% of an original cross-sectional area of the tensile specimen after fracture when evaluated using an ASTM E8 standard, and wherein the ballistic titanium alloy is manufactured by a) performing an initial melting step;

b) conducting a final melt step by vacuum arc remelting;

c) performing an intermediate forging above or below beta transus;

d) performing a final forging and rolling the alloy at a temperature below the beta transus;

e) performing a solution heat treatment of the titanium alloy; and f) performing annealing or precipitation hardening of the titanium alloy at a temperature below the beta transus.

19. A ballistic titanium alloy consisting of, in weight %, 6.0 to 6.7 aluminum, 1.4 to 2.0 vanadium, 1.4 to 2.0 molybdenum, 0.20 to 0.35 silicon, 0.18 to 0.23 oxygen, 0.16 to 0.24 iron, 0.02 to 0.06 carbon and the balance titanium together with any incidental impurities, wherein the ballistic titanium alloy is manufactured by:

a) performing an initial melting step;

b) conducting a final melt step by vacuum arc remelting;

c) performing an intermediate forging above or below beta transus;

d) performing a final forging and rolling the alloy at a temperature below the beta transus;

e) performing a solution heat treatment of the titanium alloy;

f) performing annealing or precipitation hardening of the titanium alloy at a temperature below the beta transus, wherein said ballistic titanium alloy has a UTS of at least 160 ksi, a tensile yield strength of at least 145 ksi, an elongation of at least 10%, and a V50 ballistic limit that is at least 80 feet per second greater than a base V50 ballistic limit measured for a T-64 alloy when a 0.616 inch thick plate is tested against a 12.7 mm diameter steel fragment simulating projectile, and wherein a tensile specimen of said ballistic titanium alloy has a reduction of area (RA) of at least about 25% of an original cross-sectional area of the tensile specimen after fracture when evaluated using ASTM E8 standard.

20. A ballistic titanium alloy consisting of, in weight %, 6.0 to 6.7 aluminum, 1.4 to 2.0 vanadium, 1.4 to 2.0 molybdenum, 0.20 to 0.35 silicon, 0.18 to 0.23 oxygen, 0.16 to 0.24 iron, 0.02 to 0.06 carbon, and balance titanium with incidental impurities, wherein the ballistic titanium alloy is manufactured by:

i) performing a first heat treatment of the titanium alloy to a temperature between 40 and 200 degrees Centigrade above the beta transus temperature and forging to break down the cast structure of the ingot and then cooling the alloy;

ii) performing a second heat treatment of the alloy in (i) to a temperature between 30 and 100 degrees Centigrade below the beta transus and rolling the alloy to a plate, bar, or billet; and iii) annealing the alloy in (ii) at a temperature below the beta transus, wherein the ballistic titanium alloy has a UTS greater than 950 MPa, a tensile yield strength of at least 1,000 MPa, an elongation of at least 10%, a V50 ballistic limit that is at least 80 feet per second greater than a base V50 ballistic limit measured for a T-64 alloy when a 0.616 inch thick plate is tested against a 12.7 mm diameter steel fragment simulating projectile, and wherein a tensile specimen of said ballistic titanium alloy has a reduction of area (RA) of at least 25% of an original cross-sectional area of the tensile specimen after fracture when evaluated using an ASTM E8 standard.

* * * * *